United States Patent [19]

Nakamura

[11] Patent Number: 4,721,599

[45] Date of Patent: Jan. 26, 1988

[54] METHOD FOR PRODUCING METAL OR ALLOY ARTICLES

[75] Inventor: Hideki Nakamura, Yonago, Japan

[73] Assignee: Hitachi Metals, Ltd., Japan

[21] Appl. No.: 855,333

[22] Filed: Apr. 24, 1986

[30] Foreign Application Priority Data

Apr. 26, 1985 [JP] Japan ..... 60-90339

[51] Int. Cl.[4] ..... B22F 1/00

[52] U.S. Cl. ..... 419/23; 419/29; 419/32; 419/34; 419/36; 419/37; 419/53; 419/54; 419/60

[58] Field of Search ..... 419/23, 36, 37, 32, 419/34, 53, 54, 60, 29

[56] References Cited

U.S. PATENT DOCUMENTS

| | | | |
|---|---|---|---|
| 3,940,269 | 2/1976 | Bergstrom | 75/214 |
| 3,989,518 | 11/1976 | Ruecki | 419/36 |
| 4,133,480 | 9/1978 | Rivers | 75/214 |
| 4,391,772 | 7/1983 | Bonnor et al. | 419/36 |
| 4,595,558 | 6/1986 | Baldwin et al. | 419/36 |
| 4,637,900 | 1/1987 | Frederickson | 419/36 |
| 4,643,873 | 2/1987 | Hayes | 419/36 |
| 4,664,883 | 5/1987 | Melody et al. | 419/37 |

*Primary Examiner*—Stephen J. Lechert, Jr.
*Attorney, Agent, or Firm*—Finnegan, Henderson, Farabow, Garrett & Dunner

[57] ABSTRACT

Metal or alloy articles having complicated shapes can be produced with high precision by injection molding a kneaded mixture of a metal or alloy powder and an organic binder comprising a special methylcellulose, a plasticizer, a lubricant and water, followed by removal of the organic binder and sintering.

6 Claims, No Drawings

METHOD FOR PRODUCING METAL OR ALLOY ARTICLES

BACKGROUND OF THE INVENTION

This invention relates to a method for producing metal or alloy articles having complicated configurations with high precision by mixing and kneading a metal or alloy powder with an organic binder and other materials, molding the mixture into a shape similar to the objective product by injection molding, removing the binder and other unnecessary materials, and then compacting the molding by sintering.

It is well known to produce metal or alloy articles by powder metallurgy in which a metal or alloy powder is molded by suitable molding means such as press molding, CIP molding, etc., and the molding is compacted by sintering to obtain the objective article having the desired configuration and properties. Conventional molding techniques employed in such powder metallurgy, however, have the problems of their own. For instance, in the case of press molding, it is unable to produce articles of other shapes than those obtainable by uniaxial molding. CIP molding, although capable of molding articles of three-dimensional configurations, has problems of poor precision and unsuitableness for mass production since the molding is conducted in a rubber mold. Owing to the progress in the field of injection molding of plastics in recent years, however, the techniques have been developed for molding articles of complicated configurations with high precision by mixing a metal or alloy powder with plastic material and injection-molding the mixture. The plastic material used as a binder is removed after molding by thermal decomposition or other chemical means, followed by sintering of the molding for compaction thereof. In this process, the moldability and binder removability are greatly affected by the selection of the binder used.

Several technical disclosures have been made regarding the binder useful in the metal or alloy article production process in which a metal or alloy powder is injection-molded and then compacted by sintering. For instance, Japanese Patent Publication No. 29170/76 discloses an injection molding composition made by blending a ceramic material, a lubricant such as atactic polypropylene, wax, paraffin, etc., and a plasticizer such as diethyl phthalate. Japanese Patent Laid-Open No. 113511/80 proposes mixing of a thermoplastic resin and a silane or titanium coupling agent with a ceramic or metal powder for injection or extrusion molding. Japanese Patent Laid-Open No. 229403/84 discloses many binders, typically a binder for injection molding in the production of sintered metal articles, said binder having a composition comprising 30–50% by weight of at least one of ethylene-vinyl acetate copolymer and low-density polyethylene, 19–32% by weight of methacrylic acid ester copolymer, 7–13% by weight of at least one of dibutyl phthalate, diethyl phthalate and stearic acid, and a balancing amount of paraffin wax.

In any of these disclosures, a thermoplastic or thermosetting resin generally called plastic is used as a binder and suitably mixed with a plasticizer, lubricant and/or other necessary materials, and usually the binder is used in an amount of 50% by volume ratio to the powders of raw materials, which corresponds to 8–25% by weight. Such a binder is removed after molding by making use of thermal decomposition of plastic in an oxidizing atmosphere in the case of ceramic and in a non-oxidizing atmosphere in the case of metal powder. In such binder removal operations, in order to prevent cracking or creep deformation of the molding, the heating rate has to be controlled usually below 20° C./hr, so that a long time of more than 40 hours, even reaching 100 hours in some cases, has been required for the binder removal. Thus, the conventional techniques have necessitated the industrially impractical number of steps and energy consumption. Techniques have been proposed for chemically removing the binder by using an organic solvent, but in this case, the molding becomes delicate and difficult to handle. Further, there has been a problem of the elevated product cost because of the use of costly plastic resin in an amount of more than 10% by weight and the inability to recover such resin at the time of binder removal.

With these problems, injection molding has been scarcely applied to practical use for the production of ceramics and metal articles in spite of its generally recognized advantages.

On the other hand, U.S. Pat. No. 4,113,480 discloses the use of a water-soluble binder. According to this U.S. patent, methylcellulose is selected as an organic binder which is lowered in the solubility for the solvent increases in viscosity at high temperatures compared with room temperature. To a Co-based super alloy gas atomized powder having a particle size passing a 325 mesh sieve, 1.5 to 3.5% by weight of methylcellulose, 0.25 to 2.0% by weight of glycerin, 0.1 to 1.0% by weight of boric acid and 4.0 to 6.0% by weight of water are added and mixed, followed by injection molding. Glycerin is added as a molding aid and boric acid is added as a sintering accelerating agent. The mold temperature of injection molding is 170° to 190° F. (77 to 88° C.). According to this patent, there are advantages in that the adding amount of binder is smaller than that of a prior art thermoplastic resin binder, and the removal rate is faster than the prior art thermoplastic resin binder. But there are the following disadvantages in that (1) the use of only cellulose and glycerin makes the molding properties worse and the kneaded mixture is not filled completely in fine portions of the mold, and (2) the use of boric acid is effective for accelerating the sintering due to lowering in the sintering temperature, but is not preferable because of remaining in the sintered body in an amount of 0.05 to 0.30% by weight to make the sintered body remarkably brittle. Particularly in the case of an iron-based carbon-containing material, there is produced an iron-boron compound which is hard and brittle.

SUMMARY OF THE INVENTION

An object of the present invention is to solve said prior art problems and to provide a method capable of producing metal or alloy articles having complicated configurations with high precision.

The present invention is also intended to provide a metal or alloy article production method characterized by an optimal combination of a specific binder, a plasticizer, and a mold release agent or lubricant, and optimal molding conditions, according to which the amount of organic binder used can be minimized, the resulting molded article is increased in strength, and the removal of the organic binder is easy.

DESCRIPTION OF THE PREFERRED EMBODIMENTS

The objects of this invention can be attained by using a special water-soluble organic binder which can exhibit functions of an adhesive agent, a plasticizer and a mold release agent with a minimum amount of the organic binder to give a molded article having excellent properties, and by making the organic binder removal rate fast.

According to this invention, since the organic binder is limited to a special one comprising (a) a special methylcellulose having strength of $3\times10^2$ g/cm$^2$ or more at 80° C. after thermal gelation of a 2% by weight aqueous solution thereof in an amount of 0.5 to 3.0% by weight, preferably 0.5 to 2.5% by weight, (b) at least one of esters of polyhydric alcohol ether compounds, propylene glycol and polyethylene oxide as a plasticizer at the time of molding in an amount of 0.5 to 3.0% by weight, and (c) at least one of a wax emulsion, a stearic acid emulsion, a water-soluble acrylic resin and microcrystalline wax as a lubricant or a mold release agent in an amount of 0.5 to 3.0% by weight, each based on the weight of the starting metal or alloy powder.

In an injection molding method, it is a principal requisite to obtain a tough molded article which has strength capable of material handling in the mold. For such a purpose, a binder is added. In such a case, the use of special methylcellulose is important in this invention.

Such special methylcellulose has three OH groups in glucose residue contained in the cellulose, two of said three OH groups being substituted with methoxy (—$OCH_3$) groups in a weight range of 27.5 to 31.5% by weight. Said methylcellulose is used in an amount of 0.5 to 3.0% by weight, preferably 0.5 to 2.5% by weight, based on the weight of the starting metal or alloy powder. Such a kind of methylcellulose shows a curing phenomenon at a temperature of 30° C. or higher by a gelation phenomenon. This can be applied to the molding in the same manner as in the case of thermosetting resins. The gelation strength becomes higher, when the methylcellulose has a higher degree of polymerization (a larger molecular weight). Considering the use in injection molding, the use of methylcellulose having a degree of polymerization of 340 or more (molecular weight of 63,000 or more) is preferable.

The adding amount of the methylcellulose changes depending on the thickness and shape of molded articles, and conditions and properties of the starting powder. When the amount is less than 0.5% by weight, binding strength is insufficient. On the other hand, when the amount is more than 3.0% by weight, the strength of molded articles is enhanced but the removal of the organic binder becomes difficult and thus meaningless from an economical point of view.

The use of only the methylcellulose is insufficient in plasticity. It is necessary to use as a plasticizer (b) at least one of esters of polyhydric alcohol ether compounds, propylene glycol and polyethylene oxide in an amount of 0.5 to 3.0% by weight based on the weight of the starting metal or alloy powder. Typical examples of these plasticizers are glycerin, propylene glycol and polyethylene glycol. When the amount is less than 0.5% by weight, the plasticity is insufficient. On the other hand, when the amount is more than 3.0% by weight, the improvement of plasticity corresponding to the added amount cannot be admitted, and thus such an amount is uneconomical.

Further, in order to provide lubricating properties and mold release properties, it is necessary to add as the component (c) at least one of a water-soluble wax emulsion, a stearic acid emulsion, a water-soluble acrylic resin, and microcrystalline wax in an amount of 0.5 to 3.0% by weight based on the weight of the starting metal or alloy powder.

Since the mold of an injection molding machine is heated at 80° to 120° C., there take place rapid vaporization and flying out of water in the mold. When the water content in the kneaded mixture is high, it becomes difficult to prevent the generation of cracks in molded articles. Therefore, it is necessary to reduce the water content as low as possible. From this sense, the addition of the lubricant is necessary. When the amount is less than 0.5% by weight, no effect is exhibited. On the other hand, when the amount is more than 3% by weight, the removal of the organic binder becomes difficult and thus such an amount is uneconomical.

Among various lubricants commercially available, the following ones can be used; a water-soluble wax emulsion (e.g., Macseron A, mfd. by Chukyo Yushi K.K.), a stearic acid emulsion (e.g., Celozole, mfd. by Chukyo Yushi K.K.), acrylic resin (e.g., Marbozole, mfd. by Chukyo Yushi K.K.), microcrystalline wax (e.g., Macseron M, mfd. by Chukyo Yushi K.K.), etc.

The content of water as a solvent (d) is preferable when it is as low as possible as mentioned above. When the amount of water based on the weight of the starting metal or alloy powder is less than 4.0% by weight, plasticity necessary for the molding cannot be obtained at all. On the other hand, when the amount of water is more than 12% by weight, the viscosity of the kneaded mixture is undesirable, strength of molded articles is insufficient and cracks are generated very often at the time of molding.

In addition to the selection of the components (a) to (d) for the organic binder, the temperature control of the kneaded mixture before injection molding is remarkably important. For example, it is remarkably preferable to maintain the temperature from the kneading to the injection molding from a nozzle of injection molding machine at 35° C. or lower. When the temperature is higher than 35° C., uniform kneading becomes impossible due to the progress of gelation of methylcellulose. The temperature of the cylinder portion of the injection molding machine (injector) is also maintained at 35° C. or lower by the same reasons as mentioned above.

The temperature of the mold for molding should be in the range of 80° to 120° C. When the temperature is lower than 80° C., strength of molded articles is lowered. On the other hand, when the temperature is higher than 120° C., cracks are produced on molded articles due to violent vaporization of water. The mold temperature is properly selected depending on the thickness of molded articles.

Properties of the starting metal or alloy powder are decided depending on moldability or formability, dewaxing properties (or properties for removing the organic binder), and sintering properties. From the viewpoint of sintering properties, the finer the particle size of the starting powder, the better. But when the particle size is too fine, uniform kneading becomes difficult and dewaxing properties are lowered. On the other hand, when the particle size is too large, plasticity is lowered to bring about defects on molded articles. Therefore, preferable particle size of the starting metal or alloy powder is 5 to 30 μm. As to the tap density, it is necessary to maintain the predetermined shape. In the organic binder used in this invention, the methylcellulose is the latest in pyrolysis rate and completes the pyrolysis at about 500° C. Since the handling after the completion of pyrolysis is necessary, the tap density of 40% or more is required.

The hardness of the metal or alloy powder is not particularly limited. In conventional press molding, CIP molding, the hardness of starting material powders influences greatly on the moldability and thus softening treatment of the powders such as annealing is necessary before molding. In contrast, according to this invention, such a treatment is not required at all. As shown in the following Examples, fineness in micro structure can rather be attained when non-softened powder is used in the case of tool steel powder.

Further, in the case of water atomized tool steel starting material powder, it is in a state of quenched with water and shows a hardness of as high as Hv 600 or more. In order to obtain a powder having a particle size of 5 to 30 μm, it is desirable to crush mechanically by using a crusher such as an attritor, etc. In such a case, when a powder softened by annealing after the water atomization is used, there takes place a phenomenon of flaking of the powder by the mechanical crushing. When the flaking takes place, not only the tap density is lowered rapidly but also cracks at the time of dewaxing are caused.

The present inventors found for the first time that a powder having a particle size of 30 μm or less can be obtained by mechanical crushing of a powder having a hardness (Hv) of 600 or more, generally Hv 800 or more, such as tool steel powder.

The tool steel powder bas the following composition: 0.4 to 3.0% by weight of C., 2.0 to 12.0% by weight of Cr, 8.0 to 35.0% by weight of W+2 Mo, 0.5 to 10.0% by weight of V, 15% by weight or less of Co, the balance being Fe and impurities inherently present.

Further, in case where carbide, nitride, oxide, sulfide or the like is added as an additive composition to the metal or alloy powder, it is impossible to produce an article containing such additive composition in case the added material particles cause denaturing or a phenomenon of dissolution under a humid atmosphere to such an extent that the desired product properties cannot be obtained.

Exclusive of the above-said three cases, all the metal and alloy products subjected to sintering compaction according to powder metallurgy are comprehended in the scope of the compositions contemplated in the present invention.

The present inventors found that the alloy compositions containing C are best suited for the process of the present invention. In use of such C-containing alloy compositions, C which is added to the starting powder or exists as an alloy element in the powder or as a residue of thermal decomposition of methylcellulose produces Co gas in the course of sintering in vacuo to induce reduction of the metal oxide through the reaction of $Co+Mo \rightarrow CO_2+M$ (M representing a metal atom). This decreases the oxygen content of the sintered body to enable high-density sintering. In other words, even if the composition (starting composition) contains a metal oxide which can be reduced by Co gas at or below the sintering temperature, such composition can be used if it can be turned into a desired metal or alloy composition within the allowable range a the final composition.

In the case of the metal or alloy compositions which shun containment of C, it may occur that 0.1–0.2% by weight of C be left in the sintered body due to residue of the organic binder. But in such a case, it is possible to reduce the C content of the product (after sintering) to less than 0.05% by a decarbonization reaction. Thus, if such operations are made, even the metal or alloy compositions containing no C are usable in the present invention. Further, it is possible to use the residual carbon from the organic binder as a carburizing agent to adjust the carbon content in the final product.

Also, there are the cases where an oxide, carbide, nitride and the like are properly added to the metal or alloy compositions mainly for the purpose of providing wear resistance, but it goes without saying that the present invention is applicable to such compositions within the described concept of the invention.

Regarding the form of starting powder used, whether powder of individual component elements or preliminary alloy powder or a mixture thereof is used as starting powder is a matter of sinterability and not specified in the present invention.

In the process of this invention, the binder removal rate is influenced by the atmosphere in which the binder removal is conducted. Binder removal takes place faster in the following order of atmosphere: air $>H_2>Ar\approx$ vacuum$>N_2$ gas. Binder removal is effected fastest in the air, but in the case of metal or alloy powder, air may cause oxidation of the powder to deteriorate the sinterability. Air can be used in the temperature range where the properties of the objective product are not impaired, but usually $H_2$, Ar, vacuum, $N_2$ and other non-oxidizing or reducing atmosphere are preferred.

When the temperature exceeds 400° C., the binder is almost prefectly removed, so that in the present invention the lower limit of the binder removal temperature is 400° C. Since no toxic substance is produced in the binder removal operation, such binder removal may be executed in the course of heating in the sintering furnace.

The heating rate has to be properly selected according to the molding thickness, too. In the case of a 10 mm thick molding, a heating rate of around 100° C./hr is possible.

Hereinafter, the present invention is described in further detail by way of the embodiments thereof. In the following description, all "%" is by weight unless otherwise noted.

EXAMPLE 1

To commercial carbonyl iron powder (average particle size: 6 μm) were added 1.7% of methylcellulose (SM 4000 produced by Shin-etsu Chemical Industry Co., Ltd.), 0.8% of glycerin, 1.0% of a wax emulsion (Macseron A), 0.7% of a stearic acid emulsion (Celozole), and 11% of water, and the materials were mixed by a Henschel mixer at normal temperature for 30 minutes. The thus prepared compound was molded in a 10ϕ×100 liter mold under a molding pressure of 1,100 kg/cm$^2$ by using a screw type injection molding machine. The mold temperature was set at 90° C. 40 seconds after injection, the molding was withdrawn. This green was heated in vacuo at a rate of 100° C./hr, maintained at 500° C. for one hour and then cooled in the furnace. It was then sintered in a vacuum of $10^3$ Torr at 1,300° C. for one hour. The density ratio after sintering was 93% and the oxygen content of the sintered body was 3,500 ppm. Ring-shaped test pieces were cut out from the sintered body and subjected to magnetic annealing in wet $H_2$ for 3 hours to determine the maximum permeability $\mu_{max}$, remanence Br and coercive force Hc. $\mu_{max}$ was 2,100, Br was 11,600 KG and Hc was 3.3 Oe. These figures indicate that the obtained sintered body has the satisfactory magnetic properties for use as a soft magnetic material.

EXAMPLE 2

The injection molding of Example 1 was repeated under the same conditions by using the same starting powder except for use of a binder containing 27–29% of methoxy group and 4–7.5% of hydroxypropoxy group (65-SH-4000 by Shin-etsu Chemical Industry Co., Ltd.) as methylcellulose. 40 seconds after injection molding, the molding was taken out but it was flimsy and deformed. Then after keeping in the mold for up to 3 minutes, it was again tried to take out the molding, but the molding was not sufficiently hardened and it was impossible to take out the molding in its original form.

It should be noted that the methylcellulose used in Example 1 is of the type having 3 OH groups in the glycose residue contained in the cellulose, with about 2 of said three OH groups being substituted with 27.5–31.5% of methoxy group, and containing no hydroxypropoxy group.

EXAMPLE 3

The injection molding of Example 1 was carried out under the same conditions except for use of a different type of methylcellulose (SM 25 mfd. by Shin-etsu Chemical Industry Co., Ltd.). As in the case of Example 2, the hardening of the molding was insufficient even after retention in the mold for up to 2 minutes, and it was impossible to take out the molding in its original shape.

The methylcellulose SM 25 used in Example 3 is of the type containing no hydroxypropoxy group as the one used in Example 1, but it is of the type which is weak in strength when made into a gel, showing a strength of 100 g/cm$^2$ when gelatinized from a 2% aqueous solution at 80° C. for 10 minutes. On the other hand, SM 4000 used in Example 1 has a strength of 400 g/cm$^2$.

EXAMPLE 4

An injection molding test was conducted under the same conditions as Example 1 except for use of commercially available water-atomized iron powder having an average particle size of 75 μm. The compound could not come out from the nozzle under a molding pressure of 1,100 kg/cm$^2$. When the molding pressure was raised to 1,500 kg/cm$^2$, a part of the compound was extruded but it was insufficient to completely fill the mold.

EXAMPLE 5

The atomized iron powder used in Example 4 was further crushed to an average particle size of 40 μm by a ball mill and subjected to an injection molding test under the same conditions as in Example 1. No problem arose in molding and withdrawal of the molding. The molding was heated at a rate of 100° C./hr, kept at 500° C. for one hour, then allowed to cool in the furnace, and thereafter sintered in a vacuum of $10^{-3}$ Torr at 1,300° C. for one hour. The sintered body had a density ratio of 91% and an oxygen content of 5,700 ppm. Determinations of the sintered body after magnetic annealing showed a maximum permeability ($\mu_{max}$) of 1,900, a remanence (Br) of 10,000 KG and a coercive force (Hc) of 3.5 Oe.

EXAMPLE 6

A preliminarily alloyed water-atomized powder of high-speed steel corresponding to AISIT 15 containing, by weight, 1.51% of C., 4.02% of Cr, 10.5% of W, 0.5% of Mo, 5.1% of V and 5.1% of Co, the rest being iron and unavoidable impurities, was prepared. This powder was crushed to an average particle size of 17 μm by an attritor. The $O_2$ content of the crushed powder was 6,500 ppm. To this powder were added 0.5% of C as deoxidizer, 2% of SM 4000 as an adhesive agent, 1% of glycerin, 1.5% of an acrylic resin (Marbozole), 1.0% of microcrystalline wax, and 11.0% of water, followed by mixing thereof with a Henschell mixer. The mixture was molded in a 10ϕ×100 l mold under a pressure of 700 kg/cm$^2$. (The mold temperature was 90° C.). The molding was heated in a vacuum sintering furnace to 500° C. at a rate of 150° C./hr, then further heated to 1,240° C. at a rate of 300° C./hr, maintained in this state for one hour and then cooled in the furnace. The density ratio of the sintered body was 100% and the oxygen content was 23 ppm. The same specimen was heated to 1,240° C., then oil-cooled and subjected to three times of sintering treatment in an hour at 560° C. to determine the flexural strength. It showed a hardness (HRc) of 67.1 and a flexural strength of 430 kg/mm$^2$. These values are remarkably excellent in comparison with the hardness HRc of 66.8 and flexural strength of 280 kg/mm$^2$ of the material corresponding to AISIT 15 produced by the ordinary melting process and determined under the same heat treatment conditions as described above.

EXAMPLE 7

A preliminarily alloyed water-atomized powder containing, by weight, 3.1% of C, 0.41% of Si, 3.91% of Cr, 10.3% of W, 12.12% of Mo, 7.2% of V, 9.74% of Co and the remaining percent of iron and unavoidable impurities was prepared. To this powder were added 0.3% of C and 6% of TiN of 1.2 microns in particle size, and the mixture was crushed by an attritor. To the resulting powder were further added 2.8% of methylcellulose (SM 4000), 1.2% of polyethylene glycol (PEG), 1.5% of a wax emulsion (Macseron A), 0.5% of microcrystalline wax, and 10.5% of water, followed by mixing thereof with a Henschell mixer. This mixture was molded in the same way as in Example 6, and the molding was heated in a vacuum furnace to 500° C. at a rate of 75° C./hr, then further heated to 1,200° C. at a rate of 200° C./hr, maintained in this state for one hour and then furnace-cooled. The sintered body had a density ratio of 99.8% and an oxygen content of 73 ppm. The same specimen was heated to 1,200° C., then oil-cooled and subjected to three times of sintering treatment in an hour at 560° C. to determine the flexural strength. It showed a hardness (HRc) of 72.2 and a flexural strength of 203 kg/mm$^2$.

As described above, it is possible according to the present invention to obtain metal or alloy articles having complicated configurations with high precision by means of injection molding, and thus the process of this invention is of great industrial use.

What is claimed is:

1. A method for producing a metal or alloy article which comprises mixing and kneading a metal or alloy powder with an organic binder, injection molding said kneaded mixture into a shape similar to that of the desired final product, removing the organic binder, and sintering the injected product to give a metal or alloy article with high density, the organic binder comprising (a) as an adhesive agent a kind of methylcellulose having three OH groups in glucose residue contained in the cellulose, about 2 of said three OH groups being substituted with methoxy (—$OCH_3$) groups in a weight range of 27.5 to 31.5%, in an amount of 0.5 to 3.0% by weight, (b) as a plasticizer at least one of esters of polyhydric alcohol ether compounds, propylene glycol and polyethylene oxide in an amount of 0.5 to 3.0% by weight, (c) as a lubricant or a mold release agent at least one of a wax emulsion, a stearic acid emulsion, a water-soluble acrylic resin and microcrystalline wax in an amount of 0.5 to 3.0% by weight, and (d) as a solvent for the organic binder water in an amount of 4.0 to 12% by weight, all percents by weight of the components (a) to (d) being based on the weight of the metal or alloy powder.

2. A method according to claim 1, wherein the kneaded mixture has a temperature of 35° C. or lower and the injection molding is carried out by controlling the temperature of a mold of injector at 80° to 120° C.

3. A method according to claim 1, wherein the metal or alloy powder is an iron-based alloy material for tool steel comprising 0.4 to 3.0% by weight of C, 2.0% to 12.0% by weight of Cr, 8.0 to 35.0% by weight of W +2Mo, 0.5 to 10.0% by weight of V, 15% by weight or less of Co, the balance being Fe and impurities inherently present.

4. A method according to claim 3, wherein the iron-based alloy material is water atomized alloy powder passing 100 mesh of a sieve and mechanically crushed to 30 μm or less while maintaining the hardness (Hv) of 600 or more.

5. A method according to claim 3, wherein the metal or alloy article is a cutting tool made of high speed tool steel and having a substantially true density after the sintering.

6. A method according to claim 1, wherein the removal of the organic binder is conducted with heating in vacuum, in hydrogen gas or in an inert gas, and the carbon content in the final article is adjusted by using the residual carbon after the removal of the organic binder as a carburizing agent.

* * * * *